US005494025A

United States Patent [19]

Smoker et al.

[11] Patent Number: 5,494,025

[45] Date of Patent: Feb. 27, 1996

[54] HEAT EXCHANGER FOR MULTI OIL FURNACES

[75] Inventors: Benjamin K. Smoker; David J. Yoder, both of Leola, Pa.

[73] Assignee: Clean Burn, Inc., Leola, Pa.

[21] Appl. No.: 227,393

[22] Filed: Apr. 14, 1994

[51] Int. Cl.[6] ..... F24H 3/06

[52] U.S. Cl. ..... 126/104 R; 126/76; 126/110 A; 126/116 R; 126/390; 165/159

[58] Field of Search ..... 126/104, 76, 110 A, 126/144, 116, 109, 390; 165/161, 159–160, 154, 156

[56] References Cited

U.S. PATENT DOCUMENTS

| | | | |
|---|---|---|---|
| 1,137,675 | 4/1915 | Speer | 126/104 |
| 1,334,741 | 3/1920 | Dundon | 126/104 |
| 1,462,339 | 12/1920 | Harrison | 126/104 |
| 3,106,200 | 10/1963 | Muckelrath | 126/109 |
| 3,712,286 | 1/1973 | Nelson | 126/104 |
| 4,029,145 | 6/1977 | Pfouts | 165/161 |
| 4,147,209 | 4/1979 | Persson | 165/161 |
| 4,162,887 | 7/1979 | Gray | 431/28 |
| 4,479,481 | 10/1984 | Ingersoll | 126/76 |
| 5,022,379 | 6/1991 | Wilson | 126/116 |

OTHER PUBLICATIONS

Jun., 1990, Reznor sales brochure for "Waste Oil Heater".

Aug. 25, 1992, Clean Burn Operator's Manual for Models CB–90–AH and CB–90–BH with CB–90–HS Burner.

*Primary Examiner*—Larry Jones

*Attorney, Agent, or Firm*—Larry W. Miller

[57] ABSTRACT

A heat exchanger for a multi oil furnace is disclosed wherein the external cabinet shell houses a central ventilation chamber divided into inlet and outlet sides by a generally vertical barrier. Combustion gases flow from the burner chamber into an upper bank of conduits and a lower bank of conduits, all of which pass horizontally through the ventilation chamber. Headers operably coupling the burner chamber, the upper and lower banks of conduits and a discharge opening define a flow path for the combustion gases created by the ignition of the used oil within the burner chamber. By positioning the burner chamber vertically between the upper and lower banks of conduits, the ambient ventilation air must pass over the burner chamber and the upper and lower banks of conduits twice while passing through the ventilation chamber, thereby providing a 360 degree loop of heat exchange.

18 Claims, 5 Drawing Sheets

HEAT EXCHANGER FOR MULTI OIL FURNACES

BACKGROUND OF THE INVENTION

This invention relates generally to furnaces for the burning of used oil and, more particularly, to the construction of the furnace to direct the flow of the exhaust gasses generated from the combustion of fuel within the furnace to enhance the efficiency of the operation of the furnace to heat an ambient medium such as ventilation air.

Multi oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature, which requires a preheating of the used oil to more efficiently effect a burning of the used oil products.

The burner nozzle combines a flow of compressed air with the flow of preheated used oil to atomize the used oil and inject a stream of compressed air and atomized used oil droplets into the burner chamber of the multi oil furnace where it is ignited to create a flame and provide a heat source. Known multi oil furnace burner nozzles utilize an in-line burner nozzle configuration coupled directly to the front door of the multi oil furnace.

The construction of the furnace is important in the efficiency of its operation. A burner chamber with a flame target at the end opposite the burner nozzle is provided to contain the flame and provide an exit for the combustion gases (or flue gases) past the target. Known furnace configurations, such as the Clean Burn Model CB-90 multi oil furnaces, redirect the combustion gases through a serpentine path to the side of the burner chamber utilizing conduits before discharging the gases from the furnace so that ventilation air can be forced around the conduits to absorb heat therefrom.

SUMMARY OF THE INVENTION

It is an object of this invention to improve the efficiency of the operation of a multi oil furnaces by incorporating into the furnace construction an improved flow path for the combustion gases.

It is another object of this invention to provide a multi oil furnace in which the combustion gases are direct from the rear of the burner chamber over top of the burner chamber and then underneath the burner chamber before being discharged from the furnace.

It is an advantage of this invention that the combustion gases can be isolated in a flow path from which heat can be efficiently extracted.

It is a feature of this invention that a ventilation chamber can be provided centrally within the furnace configuration.

It is another feature of this invention that the exhaust path flow path is formed by an upper bank of spaced apart conduits positioned above the burner chamber and by a lower bank of spaced apart conduits positioned below the burner chamber.

It is another advantage of this invention that the central ventilation chamber will allow the flow of an ambient medium around the burner chamber and the respective conduits to efficiently absorb heat therefrom before the combustion gases are discharged from the furnace.

It is still another feature of this invention that the changes in direction of combustion gas flow are accomplished by headers.

It is still another advantage of this invention that the combustion gas flow path is required to undertake abrupt right angle turns as the combustion gas cools to precipitate any ash or debris from the flow of the combustion gases before being discharged from the furnace.

It is still another feature of this invention that the each header downstream of the burner chamber is provided with a cleanout to allow precipitated ash and debris to be cleaned from the furnace periodically.

It is yet another advantage of this invention that the combustion gases are completely isolated from the flow of an ambient ventilation medium through the furnace.

It is still another object of this invention to provide a furnace construction that will incorporate a 360° thermal heat transfer path for the efficient transfer of heat to a ventilation medium.

It is a yet another feature of this invention that the outlet header coupling the lower bank of conduits and the discharge opening is provided with a pair of opposing lateral openings to allow a selected one of the openings to be used to discharge combustion gases from the furnace and the remaining opening to be utilized as a cleanout access opening.

It is yet another object of this invention to provide a heat exchanger for a multi oil furnace which is durable in construction, inexpensive of manufacture, carefree of maintenance, facile in assemblage, and simple and effective in Use.

These and other objects, features, and advantages are accomplished according to the instant invention by providing a heat exchanger for a multi oil furnace wherein the external cabinet shell houses a central ventilation chamber divided into inlet and outlet sides by a generally vertical barrier. Combustion gases flow from the burner chamber into an upper bank of conduits and a lower bank of conduits, all of which pass horizontally through the ventilation chamber. Headers operably coupling the burner chamber, the upper and lower banks of conduits and a discharge opening define a flow path for the combustion gases created by the ignition of the used oil within the burner chamber. By positioning the burner chamber vertically between the upper and lower banks of conduits, the ambient ventilation air must pass over the burner chamber and the upper and lower banks of conduits twice while passing through the ventilation chamber, thereby providing a 360 degree loop of heat exchange.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
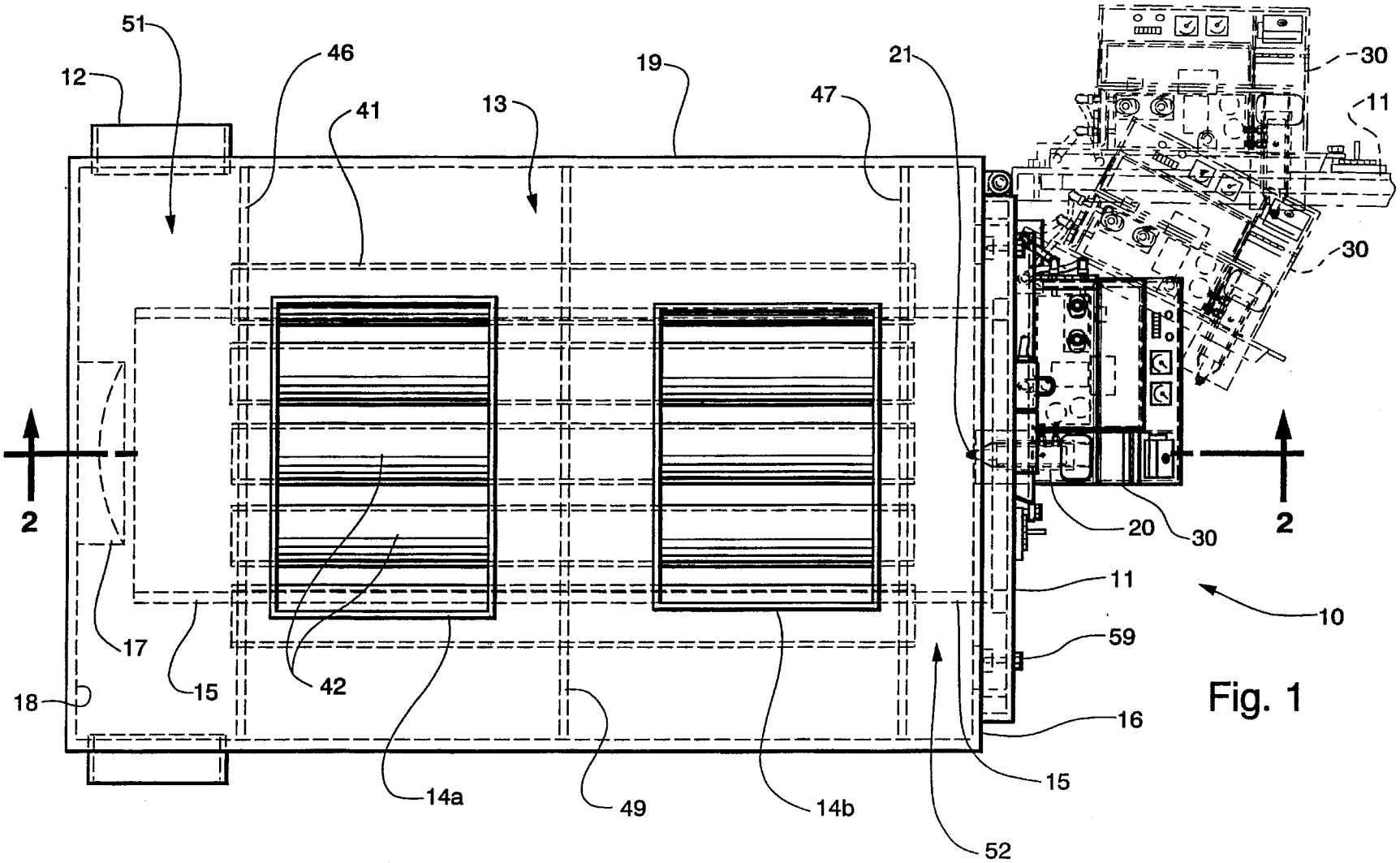
FIG. 1 is a top plan view of a multi oil furnace incorporating the principles of the instant invention, the pivotal movements of the burner housing both moving independently of the front door of the furnace cabinet and moving with the pivotal movement of the front door being shown in phantom.
Figure 2:
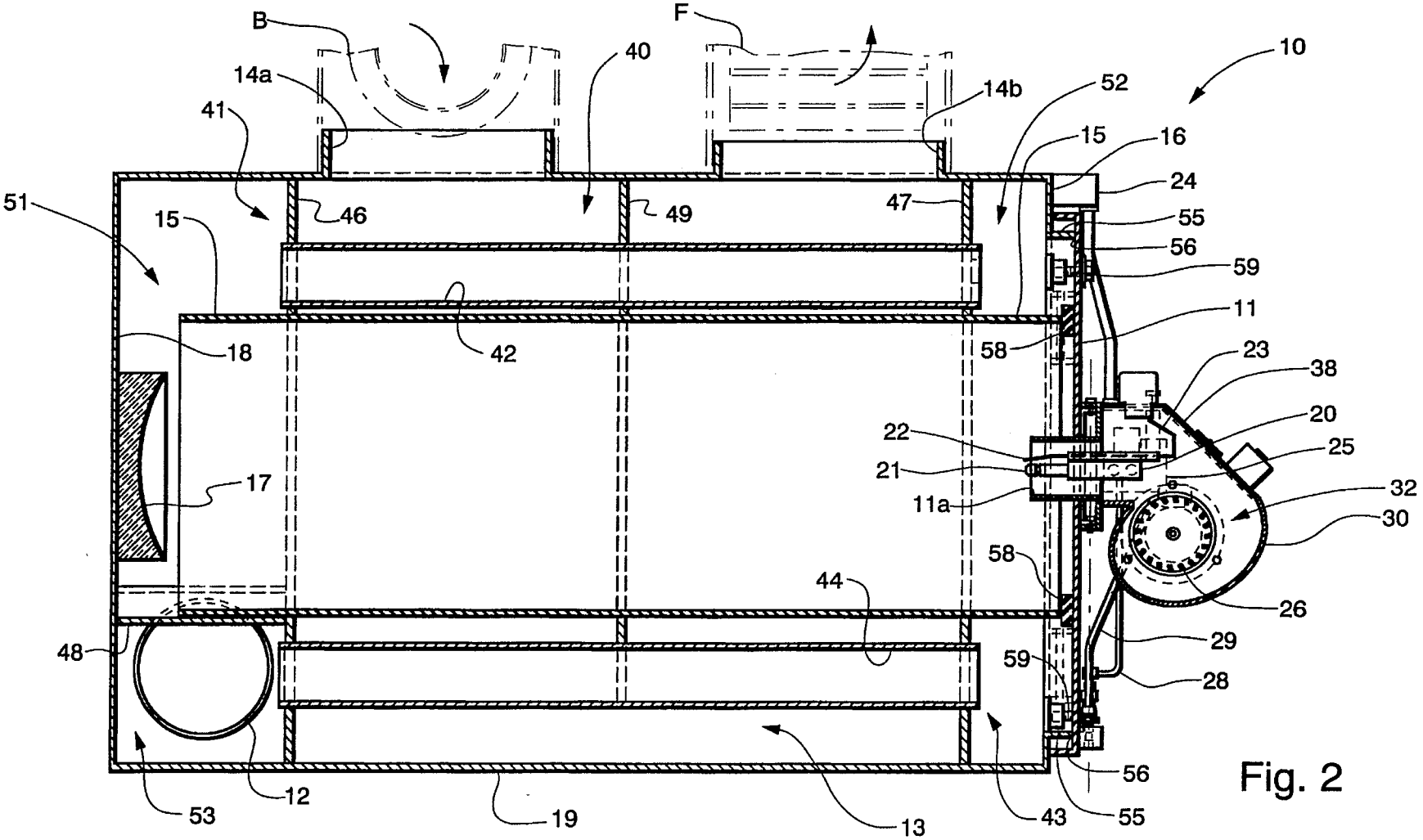
FIG. 2 is a cross-sectional view of the multi oil furnace taken along lines 2—2 in FIG. 1.
Figure 3:
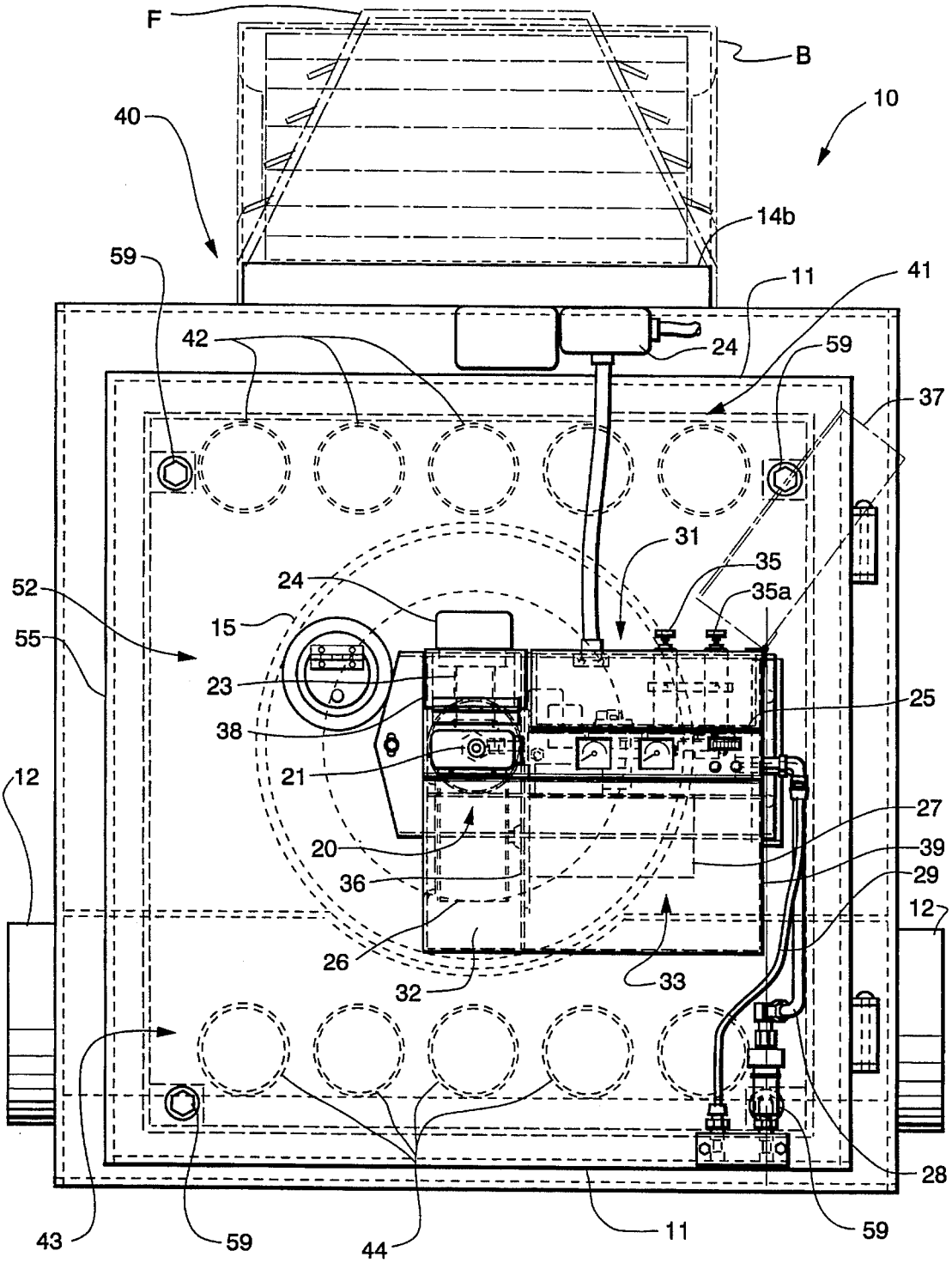
FIG. 3 is a front elevational view of the multi oil furnace shown in FIG. 1.

Referring now to FIGS. 1–3, a top plan, cross-sectional and front elevational views of a multi oil furnace incorporating the principles of the instant invention can best be seen. The furnace 10 includes a cabinet shell 19 enveloping a heat exchanger 40 and a central burner chamber 15. A burner assembly 20 is mounted on the front door 11 to fire a flame through a burner opening 11*a* into the burner chamber 15 toward a ceramic target 17 mounted on the back wall 18 of the cabinet shell 19. The configuration of the heat exchanger 40 will be discussed in greater detail below, but generally allows the circulation of clean air to be heated through a central ventilation chamber 13 to absorb heat from the burner chamber and from the circulating combustion gases before being discharged from the furnace 10. The cabinet shell 19 incorporates a ventilation air inlet opening 14*a* and a ventilation air exit opening 14*b* for access to the ventilation chamber 13 to provide for the passage of the clean ventilation air to be heated through the heat exchanger 40.

Figure 4:
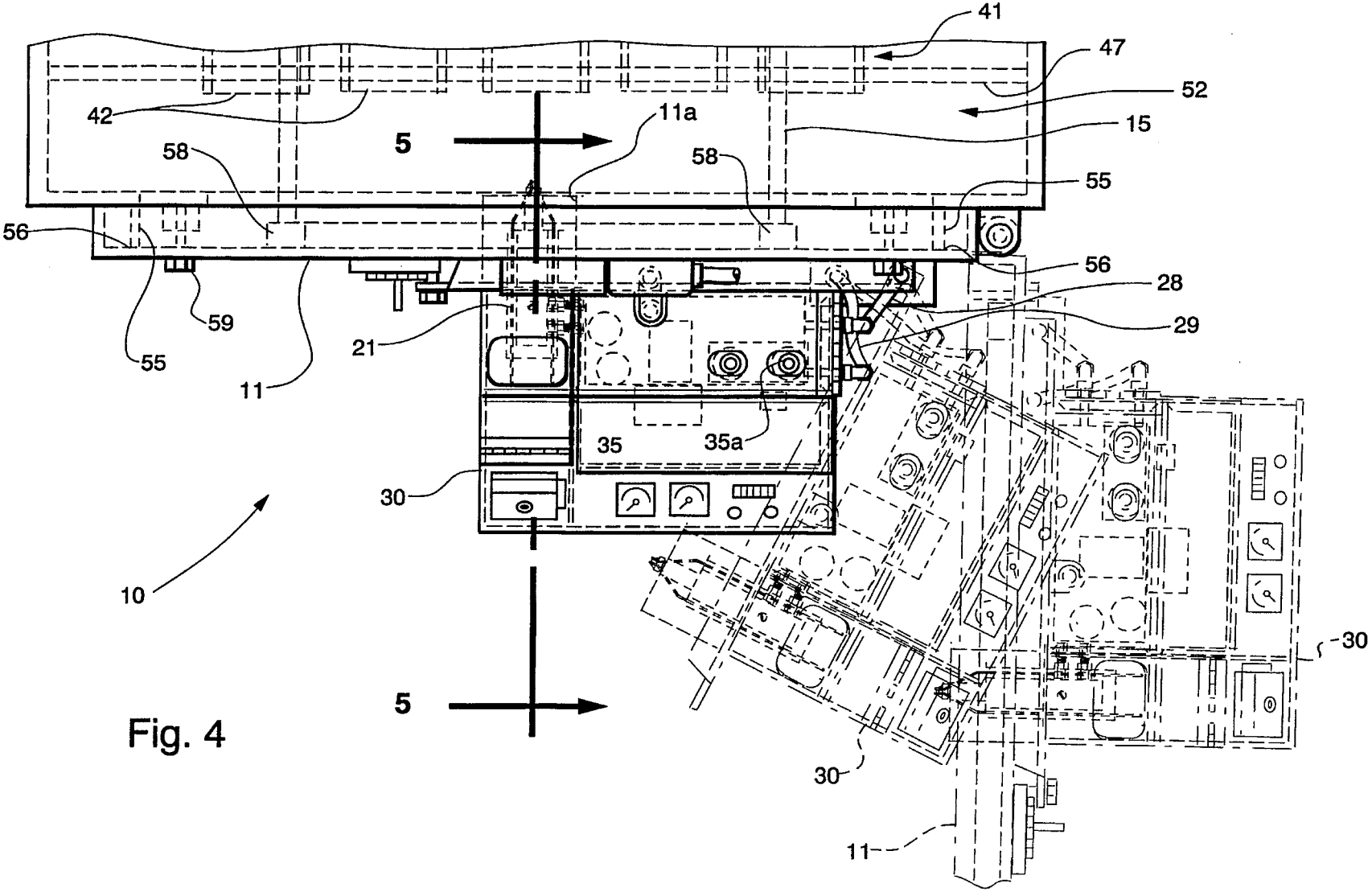
FIG. 4 is an enlarged top plan view of the pivotally mounted front door of the furnace cabinet and the pivotally mounted burner housing, similar to the view of FIG. 1, with the pivotal movements of the burner housing and the front door being shown in phantom.
Figure 5:
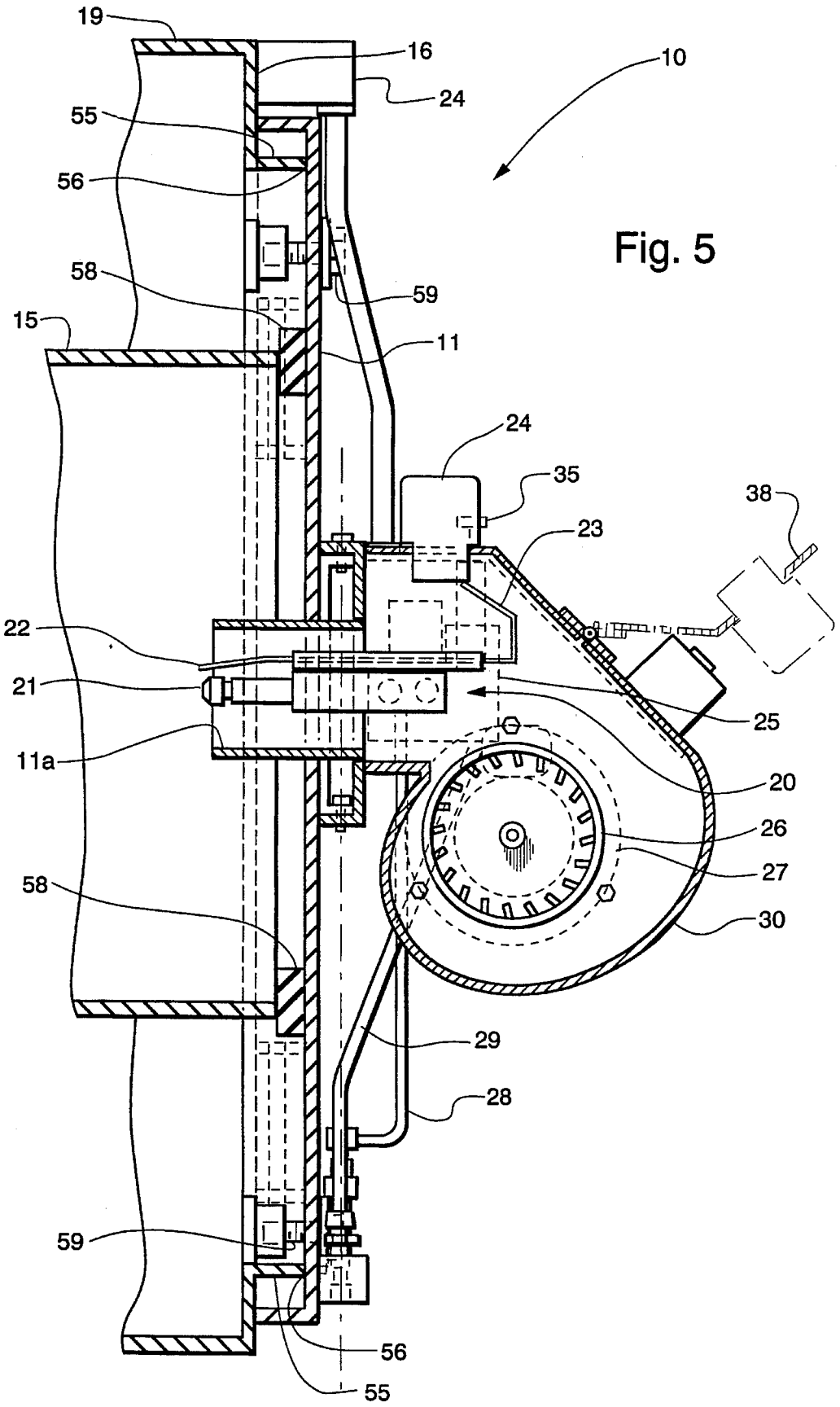
FIG. 5 is an enlarged cross-sectional view of the multi oil furnace taken along lines 5—5 of FIG. 4 to better show the relationship between the components at the front wall of furnace.

Referring now to the views of FIGS. 3, 4 and 5, the details of the burner assembly 20 can best be seen. The configuration and operation of the burner assembly 20 is described in greater detail in applicants' co-pending patent application entitled "Preheater Block for Multi Oil Furnaces", filed concurrently herewith and assigned U.S. Ser. No. 08/227,257, the descriptive portions of which are incorporated herein by reference. The burner assembly 20 includes a burner nozzle 21 and an igniter 22, which receives power through electrodes 23 connected to a source of electrical current 24, to create a flame from the used oil supplied thereto from a remote source by the used oil connecting line 28. Compressed air supplied from a remote source via the compressed air connecting line 29 is utilized by the burner assembly 20 to atomize the used oil to enhance the efficiency of the combustion process.

The burner assembly 20 includes a preheater block 25 that preheats the supplies of used oil and compressed air to a predetermined temperature, preferably in the range of 130° to 160° F., before being fed to the nozzle 21. A combustion air fan 26 and associated motor 27 provide a flow of combustion air into the burner chamber for proper combustion of the used oil at the burner nozzle 21. The burner assembly 20 is mounted within a burner housing 30, which is pivotally mounted to the front door 11 for service thereof as is described in Applicants' co-pending patent application entitled "Multi Oil Furnace Service Doors", filed concurrently herewith and given U.S. Ser. No. 08/227,258, now U.S. Pat. No. 5,408,941 the descriptive portions of which are incorporated herein by reference.

The burner housing 30 is divided into three compartments 31, 32 and 33, respectively, to improve serviceability of the controls and operative components of the furnace 10. The preheater block 25 and associated operative controls are supported in the first housing compartment 31. The used oil connecting line 28 and the compressed air connecting line 29 pass through corresponding openings in the right side wall 34 to connect with the preheater block 30. Similarly, the interior wall 36 separating the first and second housing compartments 31, 32 is provided with appropriate openings for the passage of the connecting lines supplying preheated used oil and compressed air, respectively, to the burner nozzle 21, which is supported in a cantilever manner from the preheater block 25 in the second housing compartment 32 with the combustion fan 26 blowing combustion air over the burner nozzle 21 into the burner chamber 15. The motor 27 for the combustion fan 26 is found in the third housing compartment 33.

Each of the housing compartments 31, 32 and 33, is provided with its own removable cover 37, 38 and 39, respectively. The first compartment cover 37 is hinged to the right side wall 74 and opens to expose the entire preheater block 25 and attached components for servicing, testing, etc. The first compartment cover 37 has a pair of apertures through the top surface to expose the oil and air regulators 35, 35*a* for manual manipulation without requiring the cover 37 to be opened. The third compartment cover 39 is simply attached to the right side wall 34 to cover an access opening therein to allow access to the fan motor 27. The second compartment cover 38 is hinged to and forms a portion of the curved outer peripheral portion 35 of the second compartment 72. A power transformer 24, which receives electrical power from the primary source of electrical power 24*a*, is mounted on the second compartment cover 38 and operatively extends into the second housing compartment 32 for connection with the electrodes 23 of the igniter 22.

The construction of the furnace 10 can be best seen in FIGS. 1–3. The front wall 16 of the cabinet shell 19 is provided with the front door 11 pivotally mounted thereto for pivotal movement as shown in phantom in FIG. 1. The heat exchanger 40 includes an upper bank 41 of conduits 42 oriented generally parallel to the longitudinal orientation of the burner chamber 15. These conduits 42 pass through the ventilation chamber 13 in a spaced-apart configuration to allow ambient ventilation air to flow therebetween. The heat exchanger 40 further includes a lower bank 43 of conduits 44 oriented generally parallel to the both the burner chamber 15 and the upper bank 41. These conduits 44 also pass through the ventilation chamber 13 in a spaced-apart configuration to allow ambient ventilation air to flow therebetween.

To seal the flow path for the combustion gases from the ventilation chamber 13, the furnace 10 uses header walls 46, 47 and 48, which, in conjunction with the respective walls of the cabinet shell 19 define header areas 51, 52 and 53 in which the combustion gases are required to make abrupt right angle turns within the flow path. The first header wall 46 extends around the burner chamber 15 and around the distal ends of each of the conduits 42 in the upper bank 41. Accordingly, the first header 51 couples the burner chamber 15 with the upper bank 41 and forces the combustion gases to turn ninety degrees from their normal vertically rising path of travel and flow through the conduits 42 toward the front wall 16 of the cabinet shell 19.

The second header wall 47 encircles all of the conduits 42, 44 in both the upper and lower banks 41, 43 and the burner chamber 15 and, as a result, forms a secondary front wall inwardly of the front wall 16 of the cabinet shell 19 to define the second header 52. The combustion gases traveling through the upper bank 41 of conduits 42 toward the front wall enter the second header area 52 and are forced to turn ninety degrees downwardly and then undergo a second ninety degree turn to enter the lower bank 43 of conduits 44 to travel toward the rear wall 18 of the cabinet shell 19.

The third or outlet header 53 couples the lower bank 43 of conduits 44 and the discharge opening 12 to require the combustion gases to again make a ninety degree turn from the path of travel through the lower bank 43 of conduits 44, as the discharge opening 12 is located in the cabinet shell 19 laterally of the burner chamber 15. As a matter of construction, the header wall 46 would be formed identically to the header wall 47 adjacent the front wall 16 and would extend entirely from the top of the cabinet shell 19 to the bottom, as does the front header wall 47. The two rearward header areas 51, 53 would then be separated by the third header wall 48 which would extend generally laterally below the burner chamber 15 from one side of the cabinet shell to the other and longitudinally between the first header wall 46 and the rear wall 18 of the cabinet shell 19. The third header 53 is provided with a pair of laterally opposed discharge openings 12, one of which will be used for the ultimate discharge of combustion gases from the furnace 10, while the other will be sealed with a removable door (not shown) to permit cleanout of the third header area 53.

The front door 11 exposes a substantial portion of the second header area 52 and the burner chamber 15 when the front door 11 is moved to the opened position. A lip 55 protrudes longitudinally around the second header area 52 to define the limits thereof. As is best seen in FIGS. 2 and 3, the lip 55 encompasses both the upper and lower banks 41, 43 of conduits and the centrally located burner chamber 15. A refractory seal 56, defining a sealing surface against the front door 11 engages the lip 55 to retain the combustion gases within the second header area 52 when traversing the turns in flow path between the upper bank 41 of conduits and the lower bank 43.

It will also be noted in FIGS. 2 and 3 that the burner chamber 15 extends completely through the second header area 52 and engages the front door 11 where a refractory seal 58, defining a second sealing surface against the front door 11 engages the circumference of the burner chamber 15 to prevent the re-circulation of combustion gases from the second header area 52 into the burner chamber 15. Accordingly, the flow path for the combustion gases exiting the upper bank 41 of conduits 42 must extend around the burner chamber 15 to reach the lower bank 43 of conduits 44. This circulation flow path of combustion gases provides a 360° path for thermal heat transfer to the ambient ventilation medium within the ventilation chamber 13, as will be described in greater detail below. Furthermore, the abrupt right angle turns required of the cooling combustion gases to exit the furnace assists in the precipitation of ash and debris that might be carried in the flow of the combustion gas. Due to the intense temperature within the burner chamber 15, the refractory seal 58 between the front door 11 and the burner chamber 15 is provided with greater depth than the refractory seal 56 against the lip 55. As a result the two sealing surfaces carried by the front door 11 are offset longitudinally with respect to one another.

The ventilation chamber 13 is defined as that central portion of the furnace 10 between the first header wall 46 and the second header wall 47 through which the conduits 42 and 44 and the burner chamber 15 pass. The ventilation chamber 13 is split in two by a lateral vertical barrier 49 that extends entirely from one side of the cabinet shell 19 to the opposing side and extends downwardly from the top wall of the cabinet shell 19 to encircle and support each of the upper conduits 42 and the lower conduits 44, as well as the burner chamber 15. The barrier 49 stops short of the bottom floor of the cabinet shell 19 in order to allow the internal transfer of air from back half of the ventilation chamber 13 to the front half.

The top wall of the cabinet shell 19 is provided with a rearward inlet opening **14*a* and a forward exit opening 14*b*. Typically, the openings 14*a* and 14*b* are equipped with an optional filter F and blower mechanism B, representatively shown in phantom in FIGS. 2 and 3, to force ambient room ventilation air through the ventilation chamber 15 to absorb heat from the combustion gases flowing through the conduits 42, 44 and the flame burning within the burner chamber 15. This heat exchanger 40 configuration providing a 360° loop for thermal heat transfer is advantageously utilized by the ventilation chamber 13 configuration providing a dual pass for the ventilation air around the conduits 42, 44 and burner chamber 15 before exiting the furnace 10**. The net result is an efficient transfer of heat to the ambient room air.

One skilled in the art will readily realize that the ventilation air flow could be piped to a remote location by the appropriate engagement of a conduit with the exit and/or inlet openings. Furthermore, the ventilation chamber 13 could also be sealed off and utilized as a boiler with the heat transferred from the conduits 42, 44 and burner chamber 15 to a ventilation medium other than the ambient room air.

Clean-out of ash and other debris accumulated during the burning of used oil products is easily accomplished with the configuration of the instant furnace 10. Ash will accumulate primarily where cooling combustion gases make abrupt right angle turns within the flow path. Accordingly, the greatest accumulation of ash and debris precipitated from the combustion gas flow will likely be found in the second header area 52, as the cooling combustion gases must make consecutive right angle turns to exit the upper bank 41 of conduits and enter the lower bank 43, as traverse an arcuate path around the burner chamber 15 as well. Another location for significant ash accumulation will be at the bottom of the outlet header 53.

Furnace clean-out is easily accomplished by removing the lock-down bolts 59 fixing the front door 11 to the front wall 16 of the cabinet shell 19, and allowing the front door 11 to be pivotally moved about its hinge to the open position shown in phantom in FIG. 1. This opening of the front door 11 must not be door while the furnace 10 is operating, as the used oil and compressed air lines 28, 29 are preferably disconnected to facilitate the opening of the front door 11. Preferably, the furnace 10 will be allowed to cool before opening the front door 11, which exposes the entire second header area 52. Ash and/or debris will be found at the bottom of the second header 52 accumulated against the lip 55 where the ash can be easily swept away.

While the front door 11 is opened, access to each of the conduits 42, 44 can be had to clean out any residue therein, preferably with a flue brush or the like. Likewise, the burner chamber 15 can also be cleaned of any residue without any further removal of furnace components. Accordingly, one skilled in the art can readily see that service and maintenance of the furnace is greatly improved over that previously known in the art. The outlet header area 53 can also be easily accessed through removal of a plate covering the unused discharge opening 12 laterally opposite the actual discharge opening 12 used to exit combustion gases from the furnace. As best seen in FIG. 3, the outlet header area 53 is provided with laterally opposed openings to allow the installation of a flue conduit to either side, depending on the actual installation of the furnace 10. The unused discharge opening can then be used as the clean-out access opening to clean ash and/or debris from the outlet header 53.

Following the above-described maintenance procedure, the furnace can very quickly be made operational again merely by closing the front door 11, reinstalling the lock-down bolts 49 to snugly fit the seals 56, 58 carried by the front door 11 against the lip 55 of the front header 52 and the burner chamber 15, respectively, having first ascertained that the seals 56, 58 were intact; re-connection of the used oil and compressed air supply lines 28, 29; and a re-attachment of the clean-out door in the outlet header area 53 to maintain the integrity of the air-tight second header 52 and outlet header 53.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. A heat exchanger incorporated into a multi oil furnace having an external cabinet shell including a front, rear, top, bottom and opposing side walls, said front wall having a door pivotally mounted thereon for internal access to said cabinet shell; an elongated burner chamber supported within said cabinet shell and being oriented longitudinally between said front and rear walls for the burning of a flame therewithin to generate heat; and a burner assembly operatively associated with said burner chamber to create a flame within said burner chamber, comprising:

an upper bank of conduits positioned above said burner chamber and being oriented generally parallel to said burner chamber, said upper bank of conduits being in flow communication with said burner chamber such that exhaust gases resulting from the burning of air and used oil within said burner chamber by said burner assembly will flow from said burner chamber into said upper bank of conduits;

a lower bank of conduits positioned below said burner chamber and being oriented generally parallel to said burner chamber, said lower bank of conduits being in flow communication with said upper bank of conduits such that said exhaust gases can flow from said upper bank of conduits into said lower bank of conduits; and a ventilation chamber formed within said cabinet for the passage of ambient ventilation air through said cabinet shell, said ventilation chamber having said upper and lower bank of conduits and said burner chamber passing longitudinally therethrough, said ventilation chamber having a generally vertical barrier dividing said ventilation chamber into an inlet side and an outlet side communicating with inlet and outlet openings, respectively, in said cabinet shell, such that said ambient ventilation air will engage said upper and lower banks of conduits and said burner chamber on said inlet side of said ventilation chamber to absorb heat energy therefrom on one side of said barrier and engage said upper and lower banks of conduits and said burner chamber on said outlet side of said ventilation chamber on the opposing side of said barrier to further absorb heat energy therefrom.

2. The heat exchanger of claim 1 wherein said inlet and outlet openings are located in said top wall, said generally vertical barrier extending between said opposing side walls and extending downwardly from said top wall below said lower bank of conduits.

3. The heat exchanger of claim 2 wherein said cabinet shell further includes front and rear headers for changing the direction of flow of said exhaust gases between said burner chamber and said upper and lower banks of conduits, said cabinet shell further having front and rear header walls sealing said ventilation chamber from said front and rear headers, respectively, to maintain a separation between said exhaust gases and said ambient ventilation air.

4. The heat exchanger of claim 3 wherein said cabinet shell supports an auxiliary blower couple with said inlet opening to force ambient ventilation air through said ventilation chamber.

5. In a multi oil furnace having an external cabinet shell having front, rear, top, bottom and opposing side walls, said front wall having a door pivotally mounted thereon for internal access to said cabinet shell, an elongated burner chamber supported within said cabinet shell and being oriented longitudinally between said front and rear walls for the burning of a flame therewithin to generate heat; a burner assembly mounted on said front door and being operable to ignite flows of air and a flow of used oil to create a flame within said burner chamber, exhaust gas conduits defining a flow path for exhaust gases resulting from the burning of air and used oil within said burner chamber by said burner assembly, and ventilation means for passing ambient ventilation air across said exhaust gas conduits to absorb heat therefrom, an improved ventilation means comprising:

a ventilation chamber having an inlet side and an outlet side separated by a generally vertical barrier, said inlet side being in flow communication with an inlet opening in said top wall of said cabinet shell, said outlet side being in flow communication with an outlet opening in said top wall of said cabinet shell, said barrier supporting said exhaust gas conduits and said burner chamber such that said ambient ventilation air must pass over both said exhaust gas conduits and said burner chamber while passing through both said inlet and outlet sides of said ventilation chamber such that said ambient ventilation air can absorb heat energy from said exhaust gas conduits and said burner chamber on opposing sides of said barrier, thereby providing said ambient ventilation air two passes over said exhaust gas conduits and said burner chamber for the exchange of heat energy therebetween.

6. The multi oil furnace of claim 5 wherein said ventilation chamber is defined between a front header and a rear header for the passage of ambient ventilation air through said cabinet shell, said headers sealing said ventilation chamber to define a discrete flow path for said exhaust gases.

7. The multi oil furnace of claim 6 wherein said barrier extends downwardly from said top wall between said inlet and outlet openings, stopping short of said bottom wall to allow said inlet and outlet sides to be in flow communication.

8. The multi oil furnace of claim 7 wherein said exhaust gas conduits and said burner chamber pass generally horizontally through said ventilation chamber.

9. The multi oil furnace of claim 8 wherein said exhaust gas conduits are arranged in an upper bank of conduits and a lower bank of conduits, said burner chamber being positioned vertically between said upper and lower banks of conduits.

10. The multi oil furnace of claim 9 wherein said upper and lower banks of conduits are operatively connected in flow communication by said front header.

11. The multi oil furnace of claim 10 wherein said cabinet shell supports an auxiliary blower couple with said inlet opening to force ambient ventilation air through said ventilation chamber.

12. In a multi oil furnace incorporating a heat exchanger and having an external cabinet shell having a front, rear, top and bottom walls, said front wall having a door pivotally mounted thereon for internal access to said cabinet shell, said door defining a burner opening therethrough; an elongated burner chamber supported within said cabinet shell in alignment with said burner opening and being oriented longitudinally between said front and rear walls for the burning of a flame therewithin to generate heat; and a burner assembly mounted on said front door and being operably coupled to means for providing a flow of air and a flow of used oil, said burner assembly being operable to ignite a combined flow of air and used oil to fire a flame through said burner opening into said burner chamber, the improvement comprising:

an upper bank of conduits positioned above said burner chamber and being oriented generally parallel to said burner chamber, said upper bank of conduits being in flow communication with said burner chamber such that exhaust gases resulting from the ignition of air and used oil within said burner chamber by said burner assembly will flow from said burner chamber into said upper bank of conduits; and a lower bank of conduits positioned below said burner chamber and being oriented generally parallel to said burner chamber, said lower bank of conduits being in flow communication with said upper bank of conduits such that said exhaust gases can flow from said upper bank of conduits into said lower bank of conduits with said burner chamber being located centrally between said upper and lower banks of conduits.

13. The multi oil furnace of claim 12 further comprising a ventilation chamber operable to move ambient ventilation air along two passes across said upper and lower banks of conduits and said burner chamber.

14. The multi oil furnace of claim 13 wherein said ventilation chamber is provided with a generally vertical barrier dividing said ventilation chamber into an inlet side and an outlet side said ambient ventilation air engaging said upper and lower banks of conduits and said burner chamber once on each opposing side of said barrier to permit an exchange of heat energy therebetween on both sides of said barrier.

15. The multi oil furnace of claim 14 wherein said inlet side is in flow communication with an inlet opening formed in said top wall of said cabinet shell and said outlet side is in flow communication with an outlet opening formed in said top wall of said cabinet shell, said barrier extending downwardly from said top wall between said inlet and outlet openings, terminating below said lower bank of conduits and above said bottom wall to allow said inlet and outlet sides to be in flow communication.

16. The multi oil furnace of claim 15 wherein said ventilation chamber is defined between a front header and a rear header for the passage of ambient ventilation air through said cabinet shell, said headers sealing said ventilation chamber to define a discrete flow path for said exhaust gases.

17. The multi oil furnace of claim 16 wherein said front header operatively interconnects said upper and lower banks of conduits in flow communication.

18. The multi oil furnace of claim 17 wherein said cabinet shell supports an auxiliary blower couple with said inlet opening to force ambient ventilation air through said ventilation chamber.

* * * * *